US007494270B2

(12) United States Patent
Hiranuma et al.

(10) Patent No.: US 7,494,270 B2
(45) Date of Patent: Feb. 24, 2009

(54) PORTABLE TIMEPIECE WITH A CROWN PROTECTION AND LOCKING DEVICE

(75) Inventors: Haruki Hiranuma, Chiba (JP); Koremoto Takeda, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/900,429

(22) Filed: Sep. 12, 2007

(65) Prior Publication Data

US 2008/0068934 A1 Mar. 20, 2008

(30) Foreign Application Priority Data

Sep. 19, 2006 (JP) ..... 2006-252377

(51) Int. Cl.
*G04B 37/00* (2006.01)
*G04B 29/00* (2006.01)

(52) U.S. Cl. ..... 368/288; 368/319

(58) Field of Classification Search ..... 368/286–290, 368/308, 319–321, 206
See application file for complete search history.

(56) References Cited

U.S. PATENT DOCUMENTS

| | | | | |
|---|---|---|---|---|
| 1,172,601 | A * | 2/1916 | Jaques | 368/306 |
| 1,292,446 | A * | 1/1919 | Dunham | 368/289 |
| 1,292,540 | A * | 1/1919 | Tough | 368/289 |
| 2,954,665 | A * | 10/1960 | Panerai et al. | 368/289 |
| 6,200,019 | B1 * | 3/2001 | Latini | 368/289 |
| 6,210,034 | B1 * | 4/2001 | Latini | 368/289 |
| 6,679,624 | B1 * | 1/2004 | Mouawad | 368/216 |
| 7,001,064 | B2 * | 2/2006 | Finazzi | 368/319 |
| 7,401,975 | B2 * | 7/2008 | Hiranuma et al. | 368/319 |
| 2005/0254353 | A1 * | 11/2005 | Cogoli et al. | 368/281 |
| 2008/0025158 | A1 * | 1/2008 | Hiranuma et al. | 368/308 |

FOREIGN PATENT DOCUMENTS

| | | |
|---|---|---|
| JP | 0726792 | 5/1995 |
| JP | 2004502925 | 1/2004 |

* cited by examiner

*Primary Examiner*—Felix O Figueroa
*Assistant Examiner*—Sean Kayes
(74) *Attorney, Agent, or Firm*—Adams & Wilks

(57) ABSTRACT

Even if a lock member impeding a crown from being excessively pull-moved is carelessly moved, its recovery is easy, and a function for stopping a careless movement of the crown, by the lock member, is maintained for a long period. A wristwatch possesses a case band, a crown, a protector, and a lock mechanism. A winding stem pipe is attached to the case band. The crown has a crown head having non connection relation with the winding stem pipe. This crown is supported to the winding stem pipe so as to be movable in an axial direction of this pipe. The protector is attached to the case band while facing on an end face of the crown head so as to allow an operation of this crown head. The lock mechanism is provided operably in the protector. The lock mechanism has a screw body, and a lock member linearly moving in a direction contacted with and separated from the end face of the crown head by a rotation of the screw body. The lock mechanism moves the lock member between a lock position allowing an operation in which the crown is pull-moved and a lock release position restricting the operation in which the crown is pull-moved.

6 Claims, 6 Drawing Sheets

PORTABLE TIMEPIECE WITH A CROWN PROTECTION AND LOCKING DEVICE

BACKGROUND OF THE INVENTION

1. Field of the Invention

The present invention relates to a timepiece used while being carried like a wristwatch, a pocket watch or the like.

2. Description of the Related Art

Hitherto, generally in the wristwatch, in a case where there is performed a crown operation such as time setting, a crown is rotation-operated after it is pull-moved. Therefore, in the wristwatch, there is adopted a contrivance for making such that the crown is not moved carelessly in a direction along which the crown is pull-moved by an impact exerted on the wristwatch when it falls or the like.

As one example of this contrivance, there is known a crown structure of a thread lock type. In this crown structure, a male thread part is formed in an outer periphery of a case band outside pipe end part protruding from a case band outer face of a winding stem pipe attached to the case band, and a female thread part is formed in an inner periphery of a crown head that the crown attached to the winding stem pipe so as to be movable in an axial direction of the winding stem pipe has. And, the crown is locked by the fact that the female thread part is meshed with the male thread part by rotating the crown in its tightening direction, and a pull movement of the crown and a rotation operation after it are made possible by rotating the crown in its loosening direction reversely to the former, thereby releasing the above mesh (e.g., refer to JP-UM-A-7-26792 Gazette (paragraphs 0001-0012, FIG. 1-FIG. 2)).

Further, as other example of the above contrivance, there is known a timepiece in which a push movement member is disposed coaxially in regard to the crown, a stirrup shape member forming a loop around the crown and the push movement member is attached to a case band side, and one end of a lever is rotatably attached to the stirrup shape member by a pin. The lever is used in order to control a chronograph function by push-moving the push movement member. An intermediate part of this lever has a contact point for cooperating with the push movement member, and the other end of the lever is made an operation part having a concave face. In this timepiece, since the intermediate part of the lever contacts with the crown capable of being pull-moved on the occasion of the time setting, by this lever the crown can be suppressed from carelessly moving in a pull-moving direction (e.g., refer to JP-T-2004-502925 Gazette (claim, paragraphs 0001-0024, FIG. 1-FIG. 2) (the term "JP-T" as used herein means a published Japanese translation of a PCT patent application)).

In the timepiece described in the Patent Document 1, there is considered the fact that its user erroneously drops the timepiece under a state in which the crown is rotation-operated for the time setting or the like by releasing a lock by loosening the crown. In a case where the timepiece undergoes the impact in this manner, there is the fact that the crown is excessively moved in the direction along which it is pull-moved carelessly and there is considered a fear that, following upon it, the crown or the like is injured.

Further, in the timepiece described in the Patent Document 2, although a force retaining the lever to a stationary state such that the crown is not moved carelessly depends on a friction engagement force in a rotation slide part between the lever and the pin or a friction engagement force in a rotation slide part between the pin and the stirrup shape member, an abrasion in the rotation slide part gradually proceeds following upon a rotation operation of the lever. By it, in a case where there becomes a state in which the friction engagement force decreases by, e.g., a use for a long term or the like, it is difficult to recover the friction engagement force unless a repair is performed. And, if the timepiece undergoes the impact under such a condition, since the lever is rotated at once, it is impossible to impede the crown from being excessively moved following upon it in the direction along which it is pull-moved carelessly.

SUMMARY OF THE INVENTION

It is an aspect of the present invention is to provide a timepiece in which, even if there is carelessly moved a lock member making such that the crown is not pull-moved excessively, its recovery is easy, and a function for stopping the careless movement of the crown, by the lock member, can be maintained for a long period.

The present invention possesses a case band to which a winding stem pipe is attached, a crown supported to the winding stem pipe so as to be movable in an axial direction of this pipe while having a crown head having no connection relation with the winding stem pipe, a protector attached to the case band while facing on an end face of the crown head so as to allow an operation of this crown head, and a lock mechanism provided operably in the protector, having a screw body and a lock member linearly moving in a direction contacted with and separated from the end face of the crown head by a rotation of the screw body, and moving the lock member between a lock position allowing an operation in which the crown is pull-moved and a lock release position restricting the operation in which the crown is pull-moved.

In the present invention, by an operation of the lock mechanism, since the lock member disposed in the lock position approaches to or contacts with the end face of the crown head, when the portable timepiece undergoes the impact by the fact that it falls or the like, the crown is impeded from carelessly moving in a direction along which it is pull-moved. Since the lock member disposed in the lock release position by the operation of the lock mechanism is separated from the end face of the crown head so as to allow the operation in which the crown is pull-moved, under this state it is possible to rotation-operate the crown by being pulled out. And, in a case where, on the occasion of this crown operation, the impact is exerted on this timepiece by the fact that it erroneously falls, since a maximum pulling-out quantity of the crown is restricted by the lock member in the lock release position, the crown is impeded from being excessively moved in the direction along which the crown is pull-moved.

Since the lock member linearly moves by the rotation of the screw body, suppositively even if the screw body is carelessly rotated by a vibration, the impact or the like, a motion of the lock member following upon that rotation is very small while depending on a pitch of a screw of the screw body. By this, there is no fact that the lock member is moved at once. Accordingly, there is suppressed the fact that the crown becomes a state in which it can be carelessly moved in the direction along which it is pull-moved, so that the function for stopping the careless movement of the crown, by the lock member, can be maintained for the long period.

Moreover, by linearly moving the lock member by rotating the screw body, it is possible to easily change a position of the lock member. Therefore, in a case where the lock member is carelessly moved from the lock position, the lock member can be returned to the lock position by rotating the screw body. That is, in the case where the lock member is carelessly moved, this lock member can be easily returned.

In a desirable mode of the present invention, there can be made a constitution in which a rotation-stop part is provided in the protector, and the lock mechanism has a circular operation part of a manually rotating type, which is rotatably attached to the protector with a movement in the direction contacting with and separating from the end face of the crown head being restricted, the screw body connected to the operation part, and the lock member meshed with the screw body and rotation-stopped by the rotation-stop part.

Additionally, in a desirable mode of the present invention, there suffices if a width of the protector along a height direction of the case band is made smaller than a diameter of the crown head, and a diameter of the operation part is made below the width of the protector.

In a desirable mode of the present invention, there suffices if an elastic member is attached to an end face of the lock member or the end face of the crown head.

According to the present invention, since the lock mechanism having the screw body and the lock member linearly moving in the direction contacted with and separated from the end face of the crown head by the rotation of the screw body to thereby make such that the crown is not pull-moved excessively, is provided operably in the protector, it is possible to provide a timepiece in which, even if the lock member is carelessly moved, its recovery is easy, and the function for stopping the careless movement of the crown, by the lock member, can be maintained for the long period.

DESCRIPTION OF THE PREFERRED EMBODIMENTS

Hereunder one embodiment of the present invention is explained by referring to FIG. 1-FIG. 5.

Figure 1:
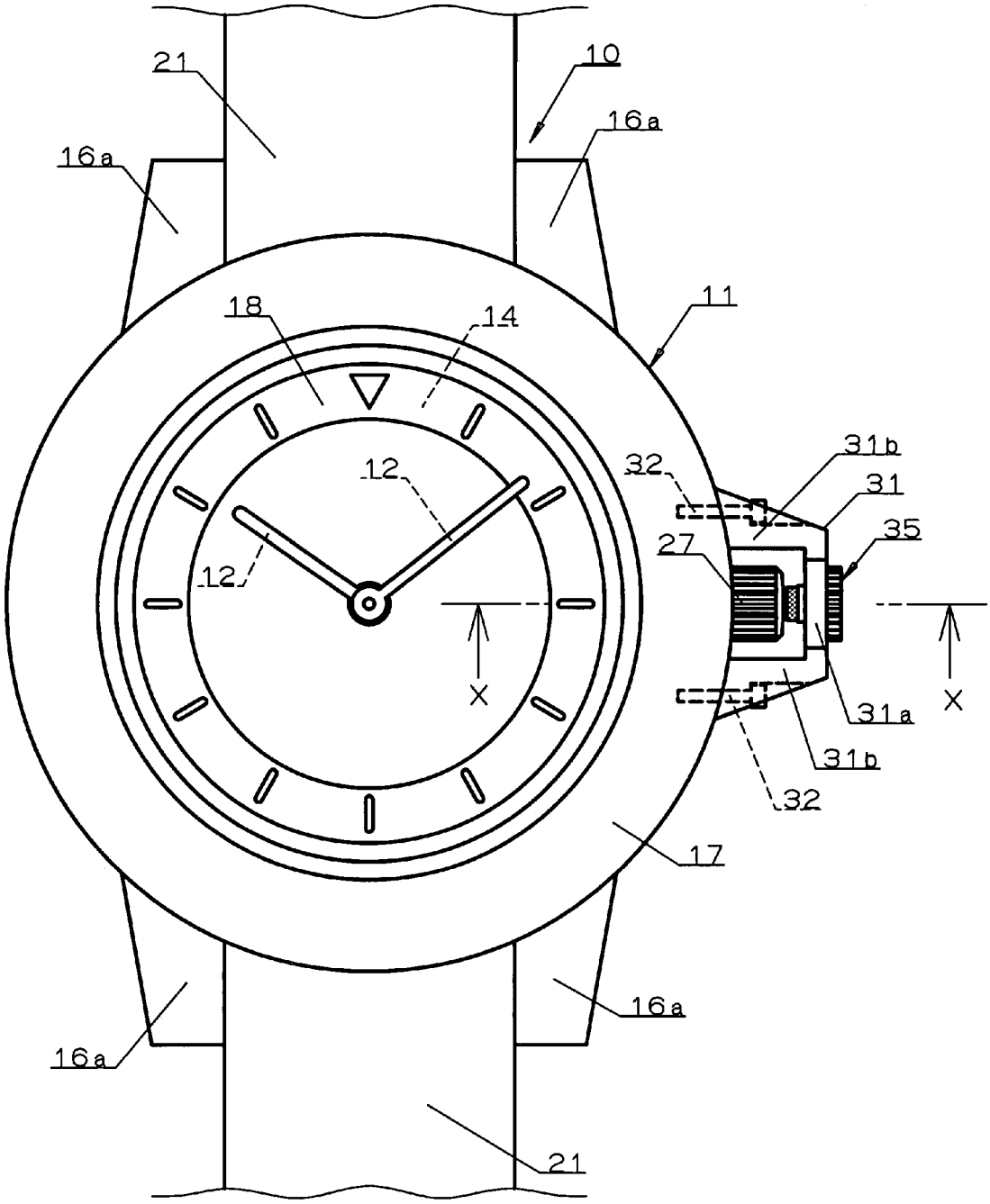
FIG. 1 is a front view showing a wristwatch concerned with one embodiment of the present invention.
Figure 2:
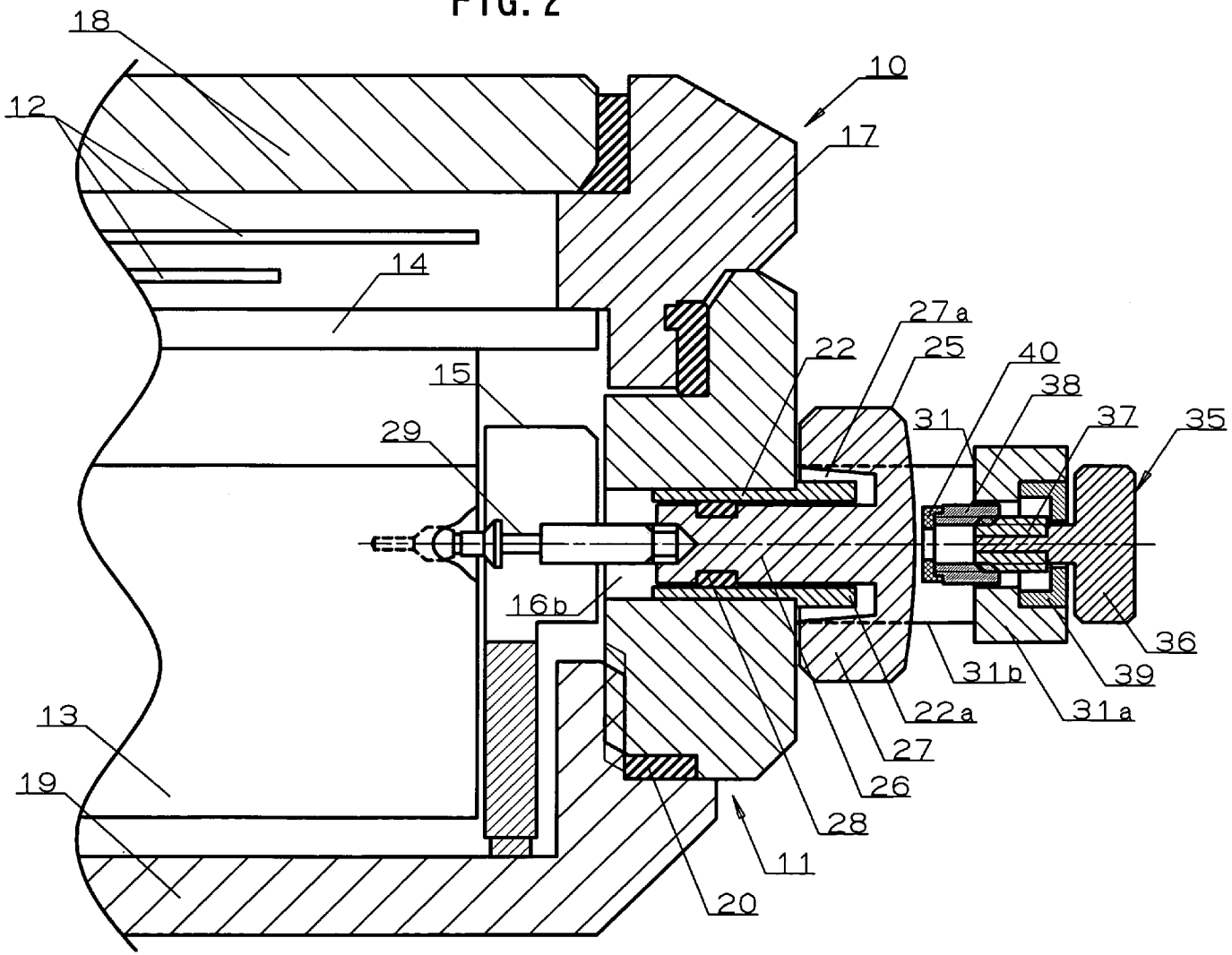
FIG. 2 is a sectional view showing along an X-X line in FIG. 1 under a state in which a crown is locked.
Figure 3:
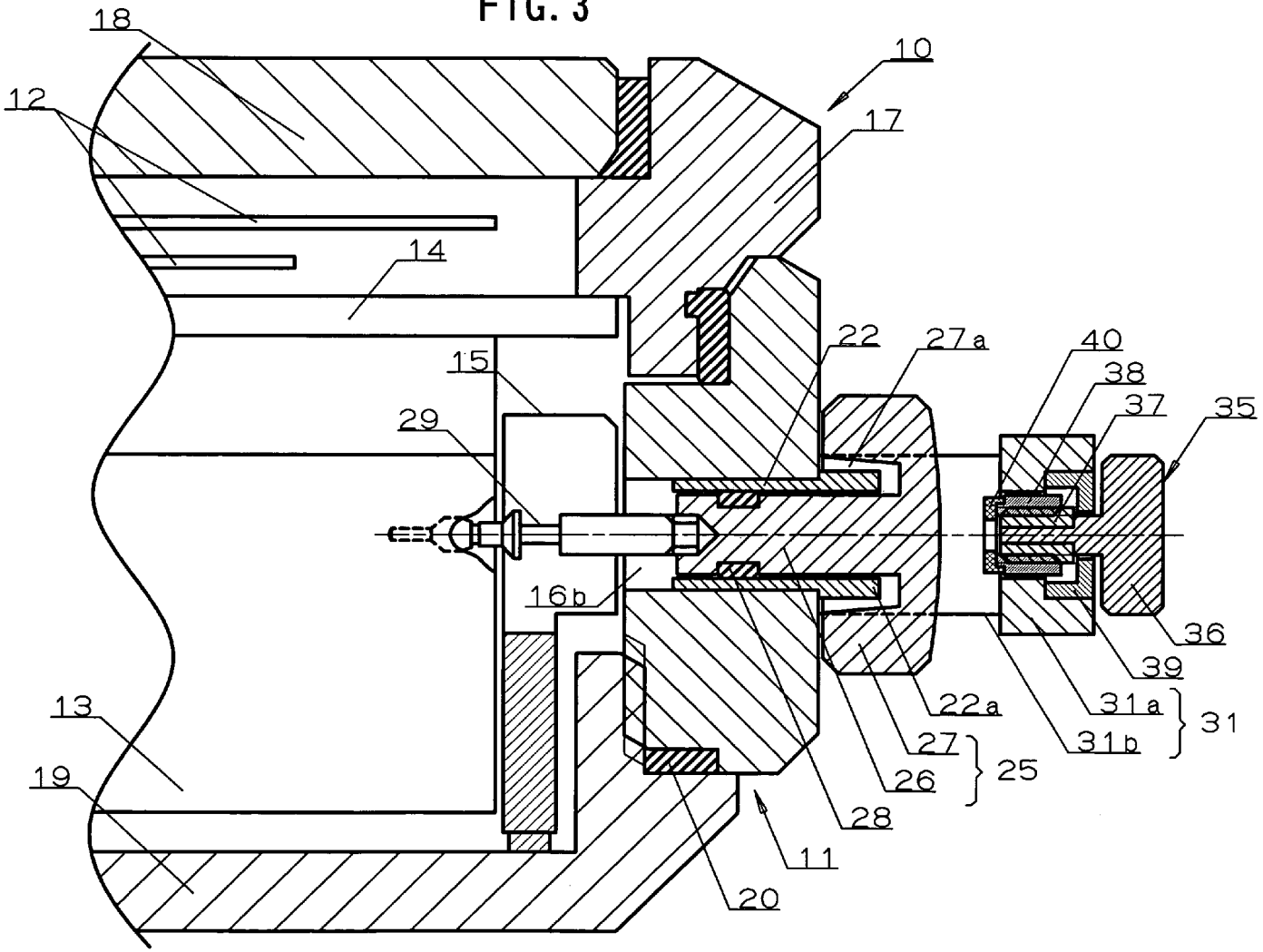
FIG. 3 is a sectional view showing along the X-X line in FIG. 1 under a state in which a lock of the crown is released.

In FIG. 1, a reference numeral 10 denotes a portable timepiece, e.g., a wristwatch used while being worn to an arm. As shown in FIG. 2 and FIG. 3, in a timepiece armor assembly 11 that this wristwatch 10 possesses, there are accommodated a timepiece movement 13 driving indication hands 12, a dial 14 attached to this timepiece movement 13, a frame-like member 15 retaining the timepiece movement 13 to the timepiece armor assembly 11, and the like.

As shown in FIG. 1-FIG. 3, the timepiece armor assembly 11 possesses a case band 16 which is desirably made of a metal and annularly made, a cover glass 18 is fluid-tightly mounted to an annular bezel 17 connected to one face (front face) in a thickness direction of the case band 16, and a case back 19 is formed in the other face (back face) in the thickness direction of the case band 16 while being detachably meshed. The indication hands 12 and the dial 14 are visible through the cover glass 18. Incidentally, in FIG. 2 and FIG. 3, a reference numeral 20 denotes an annular waterproof gasket such as O-ring having elasticity.

As shown in FIG. 1, in each of a 12 o'clock direction and a 6 o'clock direction of the timepiece armor assembly 11, member attachment convex parts 16*a* are monolithically, protrusively provided from the case band 16 and, to these member attachment convex parts 16*a*, there are respectively attached arm wear members 21 such as band or belt.

Figure 4:
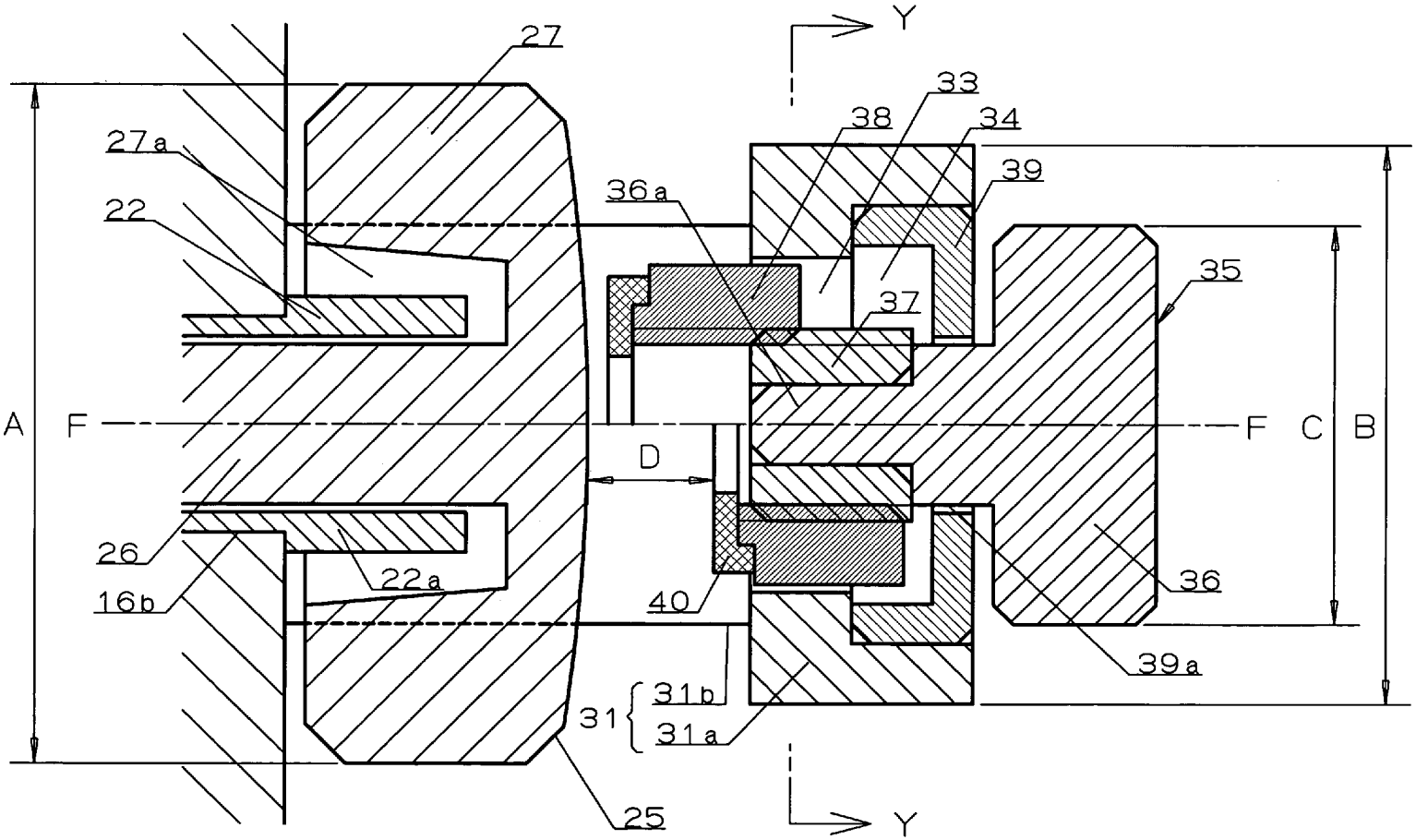
FIG. 4 is a sectional view showing, while being enlarged, surroundings of the crown of the portable timepiece of FIG. 1.

Between the member attachment convex parts 16*a* in the 12 o'clock direction and the 6 o'clock direction, e.g., in a 3 o'clock direction of the timepiece armor assembly 11, there is formed a through-hole 16*b* penetrating through the case band 16 from its inside to outside. A winding stem pipe denoted by a reference numeral 22 in FIG. 2-FIG. 4 is inserted to the through-hole 16*b* under a state in which its one part is protruded to the outside of the case band 16, and attached to the case band 16. Although the winding stem pipe 22 is fixed, e.g., by being pushed-in from the outside of the case band 16 toward the inside, instead of this it, can be blazed by using a brazing filler metal, or it may be fixed by being screwed to the through-hole 16*b* while jointly using an adhesive.

In FIG. 1-FIG. 4, a reference numeral 25 denotes a crown made of a metal. The crown 25 is formed by a crown axle 26, and a circular crown head 27 formed monolithically in one end part of the former. An annular waterproof gasket 28 comprising an elastically deformable material is mounted to an outer periphery of the crown axle 26. An annular groove 27*a* is formed between an inner periphery of the crown head 27 and an outer periphery of a crown head 27 side site of the crown axle 26.

The crown 25 is supported so as to be movable in an axial direction and rotatable in a circumferential direction in regard to the winding stem pipe 22 with the crown axle 26 being inserted to the winding stem pipe 22 from the outside of the case band 16. Under this support state, the waterproof gasket 28 is closely contacted with an inner periphery face of the winding stem pipe 22 while being elastically deformed, and the annular groove 27*a* is loosely fitted to a case band outside protrusion end part 22*a* of the winding stem pipe 22. Accordingly, the crown head 27 has no connection relation with the case band outside protrusion end part 22*a* of the winding stem pipe 22.

A winding stem 29 is connected to the crown axle 26 of the crown 25 by a mesh for instance, and this winding stem 29 is connected to the timepiece movement 13. Through this winding stem. 29, it is possible to give an operation, in which the crown 25 is pull-moved, and an operation, in which it is rotated, to the timepiece movement 13. By it, in a case where the crown 25 is rotated by being pulled out by one stage from a reference position shown in FIG. 2 and FIG. 3 for instance, a time setting can be performed. Additionally, in the wristwatch 10 in which there is made such that the crown 25 can be pulled out by more one stage (the crown 25 can be pulled out by two stages from the above reference position), it is possible to perform a setting of a day of the week by a rotation operation of the crown 25 in a pulled-out position of the second stage. Further, in a case where it is the mechanical wristwatch 10 in which the timepiece movement 13 has a mainspring, it is possible to wind up the mainspring by the rotation operation of the crown 25 in the above reference position (referred to also as a zero position).

As shown in FIG. 1 and the like, a protector 31 for guarding the crown 25 is attached to the case band 16 by using screws 32. The protector 31 comprises a monolithically molded article of a metal or the like, and is made, e.g., in an approximately U-shape, by an end face cover part 31*a*, and one pair of side face cover parts 31*b* continuing from both ends of the end face cover part 31*a* so as to be bent.

The protector 31 is screw-fixed so as to protrude from an outer face of the case band 16 by being disposed so as to strive over the crown head 27 with its one pair of side face cover parts 31*b* being disposed in a 12 o'clock-6 o'clock direction of the timepiece armor assembly 11. By it, the end face cover part 31*a* is disposed in a position covering an end face of the crown head 27 with an interstice being provided between it and the above end face, and one pair of side face cover parts 31*b* are disposed in a position covering a circumference face of the crown head 27 from the 12 o'clock-6 o'clock direction of the timepiece armor assembly 11 with an interstice being provided between it and the above circumference face.

Figure 5:
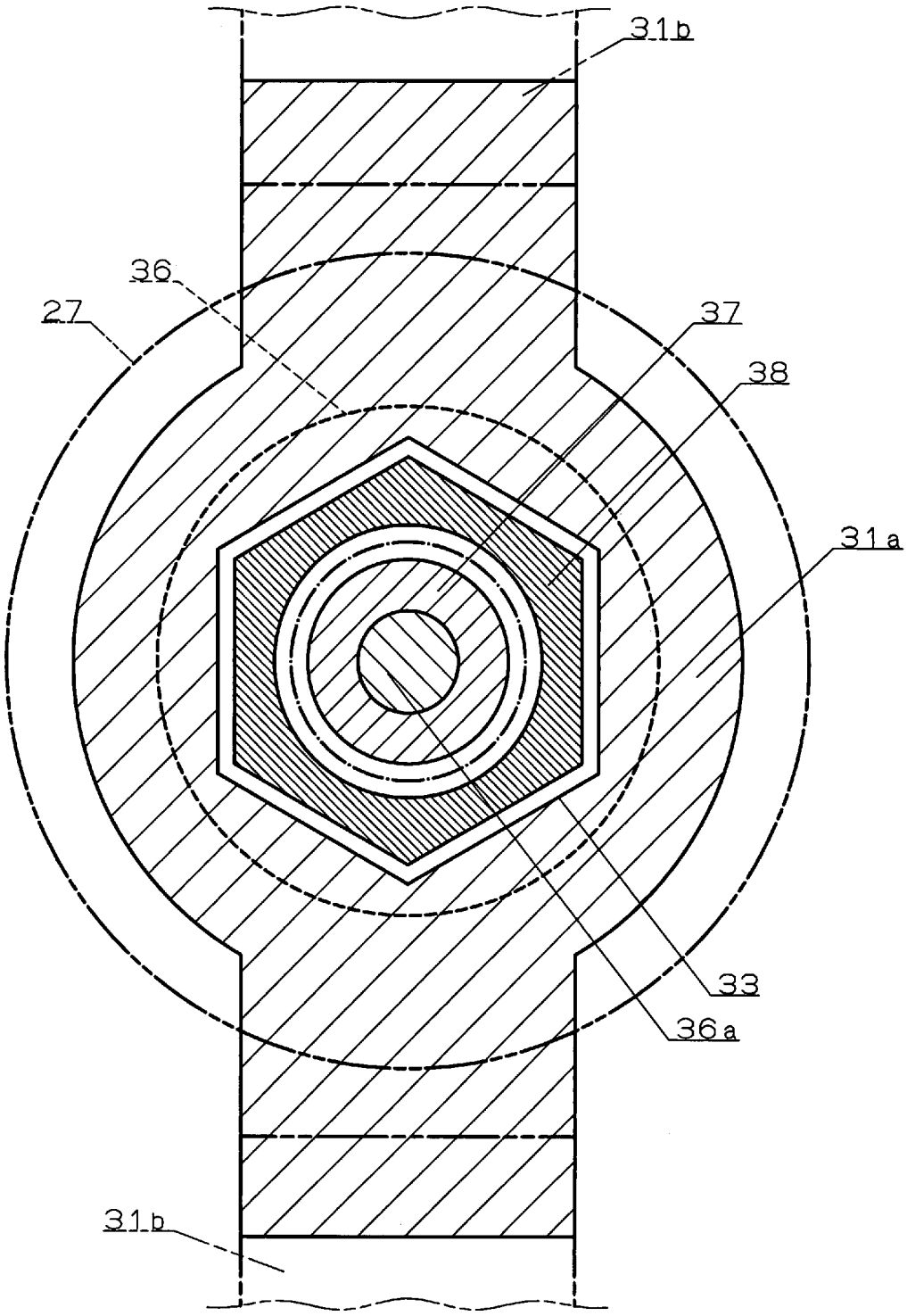
FIG. 5 is a sectional view showing along a Y-Y line in FIG. 4.

As shown in FIG. 5, upper and lower parts of the end face cover part 31*a* are protruded like a circular arc and, by it, a width B (refer to FIG. 4) of the end face cover part 31*a* along a thickness direction of the timepiece armor assembly 11 forms a maximum width of the protector 31. Accordingly, a width of the side face cover part 31*b* along the thickness direction of the timepiece armor assembly 11 is narrower than the width B of the end face cover part 31*a*. The protector 31 is one allowing an operation of the crown 25 and, therefore, a width of each part of the protector 31 along the thickness direction of the timepiece armor assembly 11 becomes narrower than a diameter A (refer to FIG. 4) of the crown head 27.

As shown in FIG. 4, in the end face cover part 31*a*, there are formed a rotation-stop part 33 for providing a lock mechanism 35 in the protector 31 so as to be operable, and a fixation hole 34. As exemplified in FIG. 5, the rotation-stop part 33 is formed by a square hole, concretely, a non-circular hole of regular hexagon. This rotation-stop part 33 is provided while being biased to a crown head 27 side within a thickness of the end face cover part 31*a* along a 9 o'clock-3 o'clock direction of the timepiece armor assembly 11. The fixation hole 34 comprises a circular hole of a larger diameter than the rotation-stop part 33. The rotation-stop part 33 and the fixation hole 34 mutually continue to thereby form a stepped hole, and this hole penetrates the end face cover part 31*a* in its thickness direction.

The lock mechanism 35 is formed while possessing an operation part 36, a screw body, 37, and a lock member 38.

As shown in FIG. 4 and the like, the operation part 36 is one of a manually rotating type, has a circular shape like a dial for instance, and is formed with a stepped attachment axle 36*a* being protrusively provided in its center part. The screw body 37 is formed with a male thread being provided in an outer periphery of a cylinder. This screw body 37 is attached to an outer periphery of a small diameter axle part of the attachment axle 36*a* while being pushed-in and, in this pushed-in, positioned in an axial direction by a large diameter axle part of the attachment axle 36*a*. An outer diameter of the screw body 37 is larger than the large diameter axle part of the attachment axle 36*a*.

The operation part 36 and the screw body 37 rotatably attached to the protector 31 with a movement in a direction contacting with and separating from an end face of the crown head 27 being restricted. For it, a retention member 39 is used. The retention member 39 is fixed to an inner periphery of the fixation hole 34 by a pushing-in, and has a center hole 39*a* fitting to an outer periphery of the large diameter axle part of its center part attachment axle 36*a*. A diameter C (refer to FIG. 4) of the operation part 36 is below a width of the protector 31, concretely, the width B of the end face cover part 31*a*.

Next, procedures for attaching the operation part 36 and the screw body 37 to the end face cover part 31*a* are explained. First, the retention member 39 is pushed-in to the fixation hole 34. After this, the attachment axle 36*a* of the operation part 36 is inserted to the center hole 39*a* of the retention member 39, thereby fitting the large diameter axle part of this attachment axle 36*a* to the center hole 39*a*. Finally, the screw body 37 is pushed-in to the small diameter axle part of the attachment axle 36*a* till this screw body 37 butts against the large diameter axle part of the attachment axle 36*a* and thus is positioned. By this, although there is allowed a certain amount of movement corresponding to a difference between a length of the large diameter axle part of the attachment axle 36*a* and a plate thickness of the retention member 39, there is assembled to a state in which the movement more than it is impeded with the retention member 39 being made a stopper.

The center hole 39*a* is a circular hole, the outer periphery of the large diameter axle part of the attachment axle 36*a* is a circular shape, and the operation part 36 and the screw body 37 connected monolithically with the former are rotatable with the center hole 39*a* being made a center. The lock member 38 is formed by a cylindrical metal-made nut having in its inner periphery a female thread part, and meshed with an outer periphery of the screw body 37. An outer periphery of the lock member 38 is formed in a non-circular hole, e.g., a regular hexagon (refer to FIG. 5), coinciding with a shape of the rotation-stop part 33. This lock member 38 is fitted to the rotation-stop part 33.

Accordingly, by the fact that the operation part 36 is manually rotated, the lock member 38 is linearly moved in an axial direction of the screw body 37, in other words, in a direction along which it is contacted with and separated from the end face of the crown head 27. There is made such that, by this linear movement, the lock member 38 is moved between a lock position shown in FIG. 2 and a lock release position shown in FIG. 3. The lock position is a position restricting an operation in which the crown 25 is pull-moved, and the lock release position is a position allowing the operation in which the crown 25 is pull-moved. In the lock position, a tip of the lock member 38 is approached to the end face of the crown head 27. Incidentally, there may be butted against it.

An end face of the lock member 38 is covered by an elastic member 40 attached to the end face. The elastic member 40 may be mounted to an end face of the crown head 27 instead of the end face of the lock member 38. Further, it is also possible to omit the elastic member 40. However, providing the elastic member 40 is desirable in the following points. There is the fact that, when a user disposes the lock member 38 to the lock position, the operation part 36 is excessively rotation-operated. In this case, since the elastic member 40 is nipped between the crown head 27 and the lock member 38, it is possible to prevent an injury of the end face of the crown head 27. Additionally, by an elastic deformation of the elastic member 40 following upon the nip, since the lock member 38 undergoes a pushing-back force to thereby vanish a mesh interstice in a mesh part, the lock member 38 is suppressed from being carelessly rotated in a loosing direction by the vibration or the like, so that the lock member 38 can be prevented from being carelessly moved to a lock release position side.

Normally, the lock member 38 of the wristwatch 10 possessing the above constitution is disposed in the lock position depicted in an upside of a center line F-F in FIG. 2 and FIG. 4. Under this disposition state, if there is attempted to pull-move the crown 25, since there becomes such that it butts at once against the lock member 38 through the elastic member 40, it is impossible to pull-move the crown 25 more than it. Therefore, even if the wristwatch 10 falls and undergoes the impact at a usual use time, it is possible to prevent the crown 25 from carelessly protruded by it from the case band 16 in a direction along which the user pull-moves the crown.

In the present embodiment, in the above lock state, since a slight interstice is formed between the elastic member 40 and the end face of the crown head 27 and thus a rotation of the crown head 27 is not restrained, it is possible to rotation-operate the crown head 27 of the crown 25 disposed in the reference position (zero stage position). Therefore, in a case where, e.g., it is the mechanical wristwatch 10 in which the timepiece movement 13 has the mainspring, as represented by the fact that the mainspring can be wound up by the rotation operation of the crown 25, a timepiece function given in the above reference position can be brought about by the rotation operation of the crown 25. Further, suppositively even in a case where the elastic member 40 butts against the crown head 27, after the operation part 36 is somewhat rotation-operated in a direction along which the screw body 37 loosens, in other words, a direction separating from the crown head 27, similarly it is possible to rotation-operate the crown 25 in the reference position.

Incidentally, like the above, since the crown 25 is locked by attaching the lock mechanism 35 to the protector 31 of the crown 25, a thread lock structure for locking the crown 25 becomes unnecessary. Accordingly, it is desirable in a point that a winding stem pipe and a crown, which have a thread part whose working is troublesome, may not be used.

In a case of performing the time setting or the like, first by manually rotation-operating the operation part 36, the lock member 38 is moved in a direction separating from the crown head 27 and disposed in the lock release position depicted in a downside of the centerline F-F in FIG. 3 and FIG. 4. By this, since there is formed a space of a length shown by a dimension D in FIG. 4, it is possible to rotate the crown 25 after the crown head 27 is pull-moved to this space by one stage or two stages.

In a case where, on the occasion of this operation, the wristwatch 10 is dropped erroneously, although the crown 25 can move in a range of the above space, the crown 25 is impeded from moving more than it so as to protrude from the case band 16 because the crown head 27 butts against the lock member 38 through the elastic member 40.

Like the above, by the lock mechanism 35 attached to the protector 31, even if the lock member 38 exists in any of the lock position or the lock release position, the crown 25 can be prevented from being abnormally protruded carelessly by an action of the impact in a direction along which the user pull-moves it.

And, as already mentioned, in the lock mechanism 35, since there is adopted a constitution in which the lock member 38 linearly moves by the rotation of the screw body 37 rotated by the operation part 36, suppositively even if the screw body 37 is carelessly rotated by the vibration, the impact or the like, the motion of the lock member 38 following upon that rotation is small while depending on the pitch of the screw of the screw body 37, so that there is no fact that the lock member 38 is moved at once. Therefore, the crown 25 is suppressed from becoming a state capable of being carelessly moved in the direction along which it is pull-moved, so that the function for stopping the careless movement of the crown 25, by the lock member 38, can be maintained for the long period.

Moreover, by linearly moving the lock member 38 by rotating the screw body 37, it is possible to easily change the position of the lock member 38. Therefore, in a case where the lock member 38 is moved in a direction deviating even slightly from the lock position, it is possible to return the lock member 37 to the lock position by operating the operation part 36 to thereby rotate the screw body 37 in the tightening direction, in other words, a direction approaching the crown head 27. Accordingly, in the case where the lock member 38 is carelessly moved, this lock member 38 can be easily returned.

Further, as already mentioned, among the diameter A of the crown head 27, the width B of the end face cover part 31*a* of the protector 31 and the diameter C of the operation part 36, there is a relation of $C \leqq B < A$. Therefore, in an operation for pull-moving the crown 25 and an operation for rotating the crown 25, the end face cover part 31*a* and the operation part 36 are difficult to become hindrances, and can be easily operated.

Additionally, since the operation part 36 of the lock mechanism 35 forms a circular dial shape not a lever, in a case where the wristwatch 10 is put-out and put-in from and to, e.g., a pocket of a clothing or the like, the operation part 36 is difficult to be caught to a stitch or the like of the pocket. Similarly, since the lock member 38 of the lock mechanism 35 is placed in an inside of the U-shaped protector 31, also in this point, the lock mechanism 35 is difficult to be caught to the stitch or the like of the pocket.

Moreover, since the operation part 36 and the screw body 37 of the lock mechanism 35 is restricted in an axial direction movement, also when the lock member 38 is disposed in the lock position and also when it is disposed in the lock release position, there is no changes in the positions of the operation part 36 and the screw body 37. Therefore, even if there is the fact that it is carried under a state in which the lock member 38 is erroneously disposed in the lock release position intact, the operation part 36 is difficult to become the hindrance and, even if it is put-out and put-in from and to the pocket or the like, the operation part 36 is difficult to be caught to the stitch or the like of the pocket.

Incidentally, for a manufacturer of the wristwatch, in a case where, in the case bands of plural kinds, under a common specification there are previously provided thread holes to each of which the screw 32 becomes possible to be screwed and, in the protectors 31 of plural kinds in dimensions, shapes and colors differing in compliance with a movement function (e.g., a function in which the crown 25 can be pulled out by one stage from the reference position, a function in which the crown 25 can be pulled out by one stage and-two stages from the reference position, or the like) of the crown 25 of the timepiece movement 13, under a common specification there are previously provided thread holes to each of which the screw 32 is inserted, it is possible to develop the wristwatches 10 of various commodity forms by a selective combination of the protector 31 in regard to the case band 16. Together with this, the protector 31 with the lock mechanism 35 can be provided to the user as an option component. Further, for the user plurally having the wristwatches 10 of the above specifications, it becomes also possible to use them by replacing the protector 31 suitable to TPO.

Figure 6:
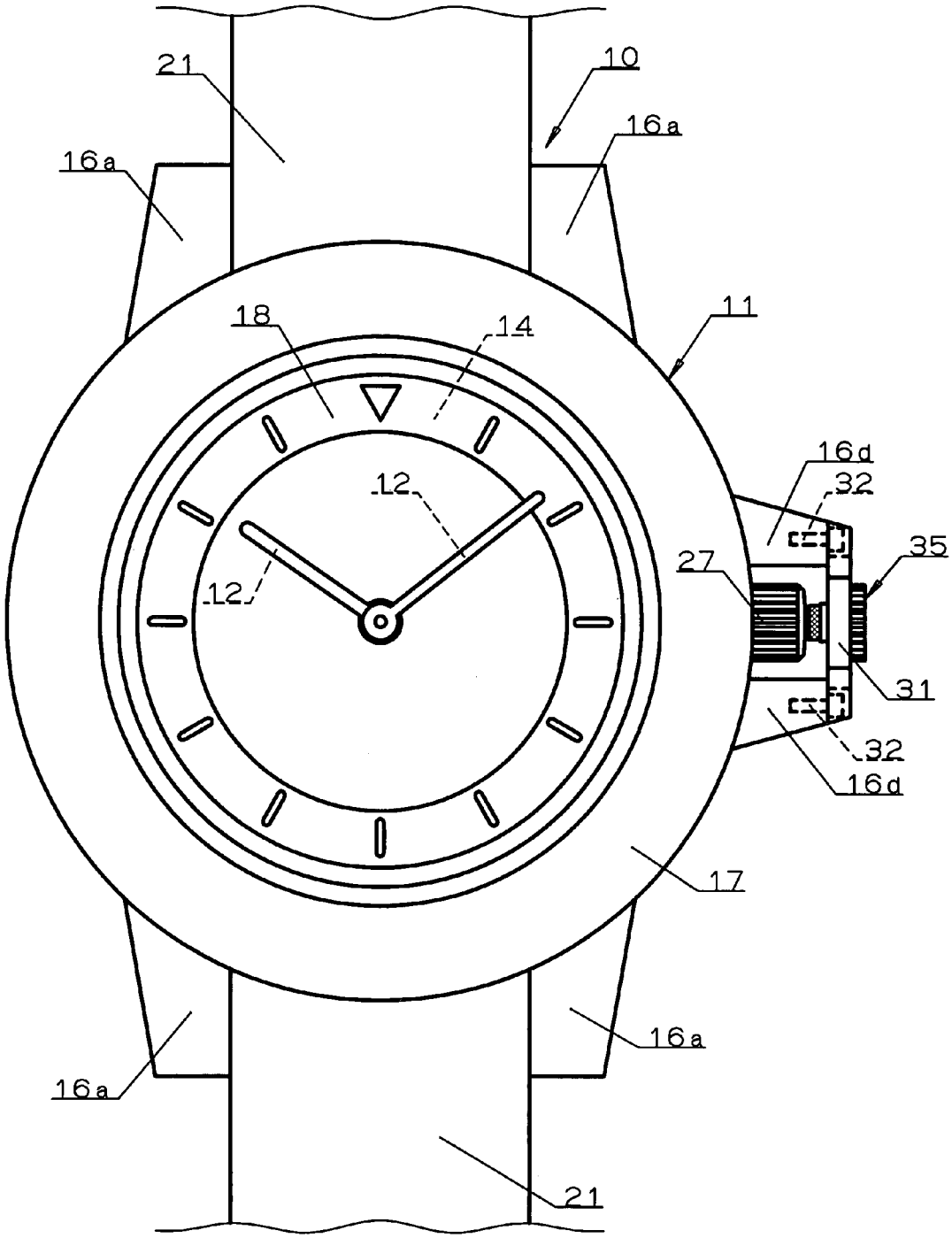
FIG. 6 is a front view showing a wristwatch concerned with other embodiment of the present invention.

FIG. 6 shows other embodiment of the present invention. In this embodiment, sites corresponding to the side face cover parts of the above one embodiment are protrusively provided monolithically with an outer face of the case band 16, and these sites are made screw reception parts 16*d*. And, the protector 31 is formed only by a site corresponding to the end face cover part of the above one embodiment, and both-end parts of this protector 31 are fixed to the screwing parts 16*d* by the screws 32.

Since the constitutions except the points explained above are the same as the above one embodiment while including the portions not shown in FIG. 6, the same reference numeral as *the above one embodiment is applied to the same portion and its explanation is omitted. Accordingly, also in this other embodiment, the problem of the present invention can be solved by attaching the lock mechanism 35 to the protector 31.

Incidentally, in the present invention, means for rotation-stopping the lock member 38 is not limited to the above one embodiment. For example, by making an outer periphery of the lock member 38 into a circular shape and providing plurally, in this outer periphery, a rotation-stop convex part such as linear convex stripe or a linear rotation-stop groove stripe, there may be provided plurally, also in the circular hole of the protector 31 to which the lock member 38 is fitted, the linear rotation-stop groove stripe or the rotation-stop convex part such as linear convex stripe. Between the rotation-stop convex part and the rotation-stop groove stripe, at least the rotation-stop groove stripe is formed while extending in the direction contacting with and separating from the end face of the crown head 27, and the rotation-stop convex part and the rotation-stop groove stripe are fitted so as to be mutually slidable.

What is claimed is:

1. A portable timepiece comprising:

a case band to which a winding stem pipe is attached, a crown supported to the winding stem pipe so as to be movable in an axial direction of this pipe while having a crown head having no connection relation with the winding stem pipe, a protector attached to the case band while facing on an end face of the crown head so as to allow an operation of this crown head, and a lock mechanism provided operably in the protector, having a screw body and a lock member linearly moving in a direction contacted with and separated from the end face of the crown head by a rotation of the screw body, and moving the lock member between a lock position allowing an operation in which the crown is pull-moved and a lock release position restricting the operation in which the crown is pull-moved.

2. A portable timepiece according to claim 1, wherein:

a rotation-stop part is provided in the protector, and the lock mechanism has a circular operation part of a manually rotating type, which is rotatably attached to the protector with a movement in the direction contacting with and separating from the end face of the crown head being restricted, the screw body connected to the operation part, and the lock member meshed with the screw body and rotation-stopped by the rotation-stop part.

3. A portable timepiece according to claim 2, wherein an elastic member is attached to an end face of the lock member or the end face of the crown head.

4. A portable timepiece according to claim 2, wherein a width of the protector along a height direction of the case band is made smaller than a diameter of the crown head, and a diameter of the operation part is made below the width of the protector.

5. A portable timepiece according to claim 4, wherein an elastic member is attached to an end face of the lock member or the end face of the crown head.

6. A portable timepiece according to claim 1, wherein an elastic member is attached to an end face of the lock member or the end face of the crown head.

* * * * *